US009353651B2

(12) United States Patent
Baindl

(10) Patent No.: US 9,353,651 B2
(45) **Date of Patent: *May 31, 2016**

(54) MOTORCYCLE HAVING A COMPACT INTERNAL COMBUSTION ENGINE

(75) Inventor: Rupert Baindl, Geretsried (DE)

(73) Assignee: KJ IP Verwaltungs GmbH, Landsberg am Lech (DE)

( * ) Notice: Subject to any disclaimer, the term of this patent is extended or adjusted under 35 U.S.C. 154(b) by 67 days.

This patent is subject to a terminal disclaimer.

(21) Appl. No.: 13/699,530

(22) PCT Filed: May 24, 2011

(86) PCT No.: PCT/EP2011/058488

§ 371 (c)(1),
(2), (4) Date: Jan. 14, 2013

(87) PCT Pub. No.: WO2011/147838

PCT Pub. Date: Dec. 1, 2011

(65) Prior Publication Data

US 2013/0118429 A1 May 16, 2013

(30) Foreign Application Priority Data

May 26, 2010 (DE) ..... 10 2010 021 613
May 26, 2010 (DE) ..... 10 2010 021 639
May 26, 2010 (DE) ..... 20 2010 007 271 U

(51) Int. Cl.
*F02B 75/22* (2006.01)
*F01L 1/34* (2006.01)
(Continued)

(52) U.S. Cl.
CPC . *F01L 1/34* (2013.01); *F02B 61/02* (2013.01); *F02B 75/221* (2013.01); *F02F 1/00* (2013.01); *F02F 7/0012* (2013.01)

(58) Field of Classification Search
CPC ..... F02B 75/221; F02B 75/22; F02B 61/02; F02B 7/0012; F02F 1/00; F02F 1/3214; F01L 1/34
USPC ..... 123/54.4–54.8, 193.5
See application file for complete search history.

(56) References Cited

U.S. PATENT DOCUMENTS 2,808,041 A 10/1957 Dolza
3,521,613 A 7/1970 Celli
(Continued)

FOREIGN PATENT DOCUMENTS

DE 10 2004 042 765 A1 6/2005
EP 1 146 219 A1 10/2001
(Continued)

OTHER PUBLICATIONS

Krueger, "Sechszylinder—Motoren Mit Kleinem V-Winkel", MTZ Motortechnische Zeitschrift, Bd. 51, Nr. 10, pp. 410-418 (1990) (English Abstract on p. 2 of document).
(Continued)

*Primary Examiner* — Marguerite McMahon
(74) *Attorney, Agent, or Firm* — Fay Sharpe LLP

(57) ABSTRACT

A motorcycle having an internal combustion engine includes a cylinder arrangement in the form of a VR cylinder arrangement having rows of cylinders which are arranged in an offset manner and are nested into each other. The crank drive acts crosswise onto a crankshaft and a common cylinder head is provided. The inlet channels in the cylinder head are arranged in an identical manner for all of the cylinders. Alternatively, the inlet channels of the one row of cylinders are disposed adjacent to one of two or three camshafts and the inlet channels of the other row of cylinders are disposed on the other side of the camshaft.

17 Claims, 7 Drawing Sheets

Figure 1:
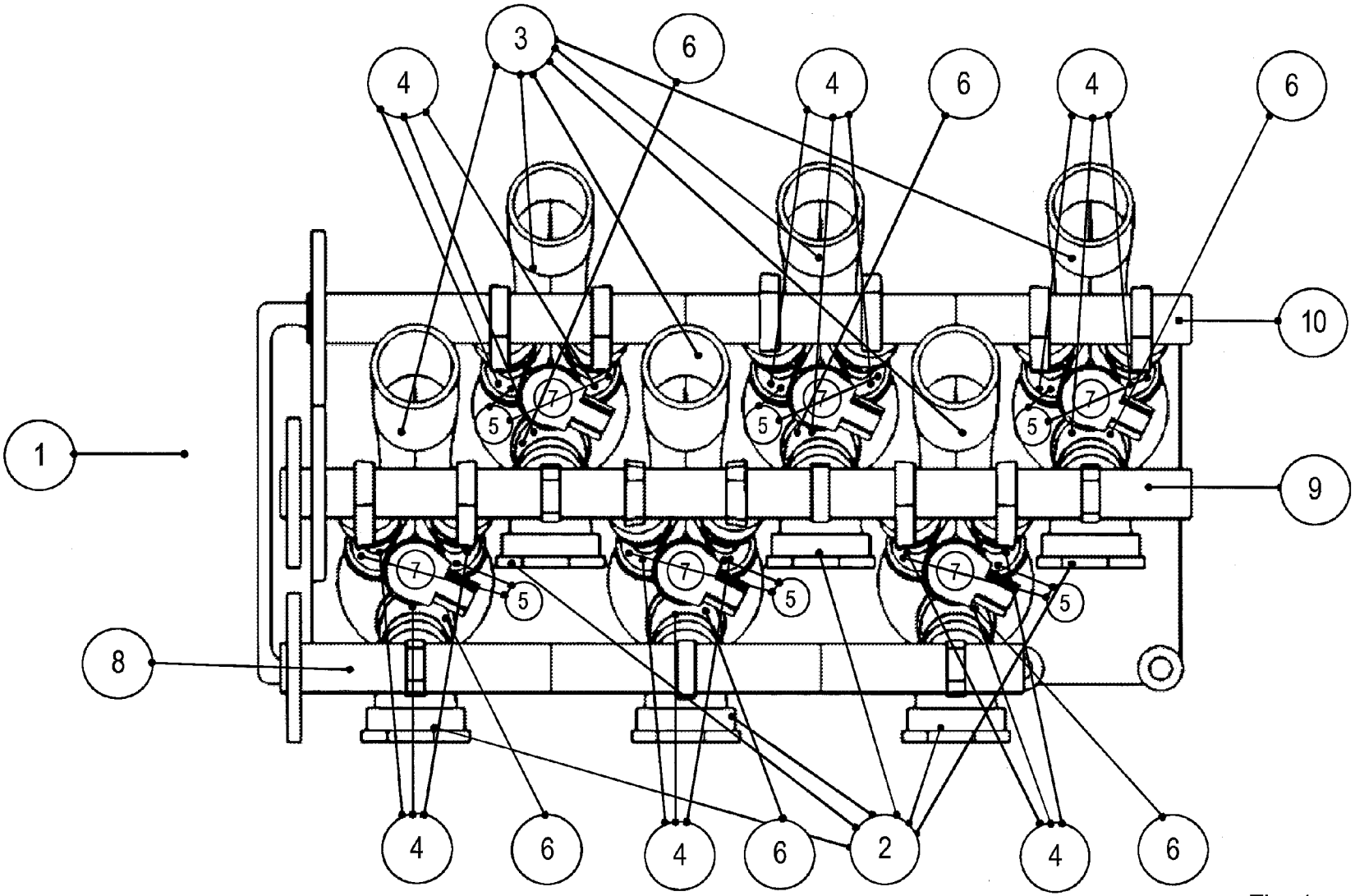

(51) Int. Cl.

| | |
|---|---|
| ***F02B 61/02*** | (2006.01) |
| ***F02F 7/00*** | (2006.01) |
| ***F02F 1/00*** | (2006.01) |

(56) References Cited

U.S. PATENT DOCUMENTS

| | | | | |
|---|---|---|---|---|
| 4,194,469 | A * | 3/1980 | Kruger | 123/54.6 |
| 4,319,548 | A * | 3/1982 | Kruger | 123/90.27 |
| 4,787,342 | A | 11/1988 | Matsumori et al. | |
| 2006/0011153 | A1* | 1/2006 | Yamazaki | 123/54.4 |
| 2008/0168957 | A1* | 7/2008 | Neese | 123/54.4 |

FOREIGN PATENT DOCUMENTS

| | | | |
|---|---|---|---|
| EP | 1 553 280 | A1 | 7/2005 |
| GB | 860011 | A | 2/1961 |
| JP | 62-228645 | A | 10/1987 |

OTHER PUBLICATIONS

International Search Report of International Application No. PCT/EP2011/058488 dated Dec. 12, 2011 with English Translation.

International Preliminary Report on Patentability of International Application No. PCT/EP2011/058488 dated Dec. 6, 2012 with English Translation.

* cited by examiner

MOTORCYCLE HAVING A COMPACT INTERNAL COMBUSTION ENGINE

The invention relates to a motorcycle having a compact internal combustion engine.

A motorcycle of this type is known from DE 10 2004 042 765 B4. The internal combustion engine thereof comprises a VR cylinder arrangement with rows of cylinders which are arranged in a staggered manner and pushed into each other, the internal combustion engine being installed with a transverse crankshaft. The crank drive also has a restricted effect on the crankshaft, so the two planes which are formed by the cylinder axes of each row of cylinders intersect below the crankshaft axis. A common cylinder head is present for each two rows of cylinders. This comprises three camshafts in one exemplary embodiment.

Other design features of the cylinder head are not described in DE 10 2004 042 765 B4. In particular, it is not apparent how the gas ducts are arranged and shaped.

Except for the above-mentioned document, no motorcycles having an internal combustion engine with a VR cylinder arrangement have been known until now.

It is sufficiently well known that gas ducts which are as short and straight as possible are required in the cylinder head in order to achieve high powers in motorcycle engines.

EP 1 146 219 A1 already discloses the arrangement of gas ducts in a cylinder head of a VR engine. Inlet and outlet ducts are largely routed horizontally, i.e. transversely to the cylinder axis. All the outlet ducts open out on one side of the cylinder head, all the inlet ducts open out on the opposite side. The outlet ducts of the row of cylinders which is in each case offset to the rear are considerably longer than those of the ones at the front. The inlet ducts also have these differences in length, but are arranged in a mirrored manner. This duct arrangement is less suited to motorcycles, as a high power density cannot be achieved in particular with the very unequal inlet ducts.

The object of the invention is to provide a suitable cylinder head for a generic motorcycle having an internal combustion engine with a VR cylinder arrangement, with which high engine powers can be achieved.

The solution is provided by the motorcycle according to Claim 1 or 2.

Advantageous configurations are specified in the dependent claims.

According to Claim 1, the object is achieved in that the cylinder head comprises a group of two, three, four or five gas ducts per cylinder, the group comprising at least one outlet duct and at least one inlet duct, and the geometric arrangement of the inlet ducts of one group being the same for all the cylinders.

The fact that the geometric arrangement of the inlet ducts is equal for all the groups means that the shape and profile of the inlet duct for one inlet valve, or of the inlet ducts in the case of several inlet valves, of a cylinder are the same for all the cylinders. This means in particular that this same geometric arrangement of the inlet ducts for the cylinders of the rear row of cylinders is the same as the geometric arrangement of the inlet ducts of the front row of cylinders. The inlet ducts for the cylinders of the rear row of cylinders can be aligned in the same direction as the inlet ducts of the front row of cylinders, but they can also be arranged in a mirrored manner with respect to each other. An identical arrangement for all the cylinders is also advantageous for the outlet ducts. With all the arrangements mentioned, it is also advantageous if the dimensions of the gas ducts of each cylinder are the same.

The use of the same geometric arrangement of the gas ducts for the front and rear rows of cylinders means that the same flow conditions can be achieved for all the cylinders, so uniform engine running is ensured over the entire speed range. With the use of identically shaped inlet ducts for all the cylinders, high engine power and the greatest possible synchronisation and smooth running of the engine are achieved.

Claim 2 describes a further solution according to the invention such that, when the crankshaft lies transversely (transverse installation), the inlet ducts of the rear row of cylinders are arranged behind the rear camshaft and the inlet ducts of the front row of cylinders are arranged in front of the rear camshaft or, when the crankshaft lies longitudinally (longitudinal installation), the inlet ducts of one row of cylinders are arranged to the left of an outer camshaft and the inlet ducts of the other row of cylinders are arranged to the right of the said camshaft.

The described arrangement of the inlet ducts on both sides of the inlet-side camshaft ensures that inlet ducts of the same length and shape are used, which are also relatively short, as a result of which a high engine power and the greatest possible synchronisation and smooth running of the engine are likewise achieved.

In a particularly advantageous development of the solutions according to the invention according to Claims 1 and 2, the engine comprises six cylinders.

A favourable development of the solution according to Claim is also that, when there is a plurality of identical valves per cylinder, the inlet ducts and outlet ducts of one cylinder form a group and the geometrical arrangement or shape of the inlet ducts of one group is the same for all the cylinders.

It is also advantageous that the geometrical arrangement (shape) of the outlet ducts of one group is the same for all the cylinders.

In a further configuration, the internal combustion engine according to the invention comprises two, three, four or five valves per cylinder and one or two spark plugs per cylinder. Two, three or four camshafts can be installed per cylinder head. The gas ducts of the inlet valves of one cylinder can be combined to form one duct. The use of two inlet valves and one outlet valve per cylinder has proven particularly advantageous. If a plurality of outlet valves is used per cylinder, it is likewise favourable to combine the outlet ducts of one cylinder belonging to the individual valves to form one outlet duct.

In one configuration, the internal combustion engine is installed in the motorcycle with a transverse crankshaft, which is also referred to as a transverse installation. Then the cylinder head covers a front row of cylinders and a rear row of cylinders.

In another configuration, the internal combustion engine is installed in the motorcycle with a longitudinal crankshaft, which is referred to as a longitudinal installation. Then the cylinder head covers a left row of cylinders and a right row of cylinders.

If a plurality of inlet valves is advantageously provided per cylinder, that is, in a group, the ducts of one cylinder belonging to the inlet valves branch out from one common duct. If a plurality of outlet valves are provided, the outlet ducts of a cylinder belonging to the outlet valves merge to form one outlet duct.

The inlet ducts advantageously lead upwards and, in the case of transverse installation, the outlet ducts are curved forwards or backwards. In the case of longitudinal installation, the outlet ducts are curved to the left or right.

In the case of transverse installation, the forwardly curved outlet ducts of the rear row of cylinders are also arranged between the forwardly curved outlet ducts of the front row of cylinders, the outlet duct of the outermost cylinder of the rear row of cylinders being arranged adjacently to the outlet duct of the cylinder of the front row of cylinders situated in front of it.

The cylinder head can be designed with one, two or three camshafts, the embodiments having two or three camshafts being particularly favourable. In the case of three camshafts, the central camshaft actuates the inlet valves of one row of cylinders and the outlet valves of the other row of cylinders. These valves are then arranged in an inclined manner with respect to each other. The front camshaft only actuates the outlet valves of the front row of cylinders, the rear camshaft only actuates the inlet valves of the rear row of cylinders. The valves can be actuated directly by means of bucket tappets or else via rocker arms.

If two camshafts are used with transverse installation and identically aligned duct groups, the inlet ducts of the rear row of cylinders can be arranged behind the rear camshaft and the inlet ducts of the front row of cylinders can be arranged between the front and rear camshafts. In this case too, the valves can be actuated directly by means of bucket tappets or else via rocker arms.

If two camshafts are used with longitudinal installation, the inlet ducts of one row of cylinders lie to the left of one camshaft, the inlet ducts of the other row of cylinders lie to the right of the said camshaft.

If two camshafts are used with mirrored duct groups, all six inlet ducts are arranged between the two camshafts and lead upwards.

Alternatively, when three camshafts are used with transverse installation, the inlet ducts of the front row of cylinders can be arranged behind the central camshaft and in front of the rear camshaft, and the inlet ducts of the rear row of cylinders can be arranged behind the rear camshaft.

In the case of longitudinal installation, the inlet ducts of one row of cylinders are then arranged adjacently to the central camshaft, the inlet ducts of the other row of cylinders are arranged outside the camshaft arranged on the same side.

In the case of transverse installation, all the outlet ducts favourably open out of the cylinder head at the front in the longitudinal direction of the vehicle, and the openings of the outlet ducts of the rear row of cylinders are offset to the rear in the longitudinal direction of the vehicle with respect to the those of the front row of cylinders.

In the case of longitudinal installation, all the outlet ducts open to the left or right.

It is also favourable that the duct dimensions of the gas ducts are the same for all the groups.

The alignment of the duct groups for the front and rear rows of cylinders can be the same but they can also be mirrored. In the case of mirrored arrangement of the groups, all the inlet ducts can open out in the top centre of the cylinder head and the outlet ducts can open out on both sides of the cylinder head. Conversely, all the outlet ducts can also run centrally and the inlet ducts can open out on both sides of the cylinder head.

If the outlet ducts run in a curved manner to the side of the cylinder head, then they run under the camshafts which lie in the direction of flow, i.e. they are situated under the central camshaft and the one behind it if three camshafts are used, or only under one of the two camshafts if two camshafts are used.

The spark plugs are advantageously arranged centrally between the valves of the cylinders and lead upwards.

The internal combustion engine according to the invention can also comprise cylinders in the W arrangement, four rows of cylinders then being present with in each case one cylinder head for two rows of cylinders, two cylinder heads overall.

Exemplary embodiments of the motorcycle according to the invention are presented in the figures described below. In particular, in the figures:

FIG. 1: shows a view of the cylinder head from above

Figure 2:
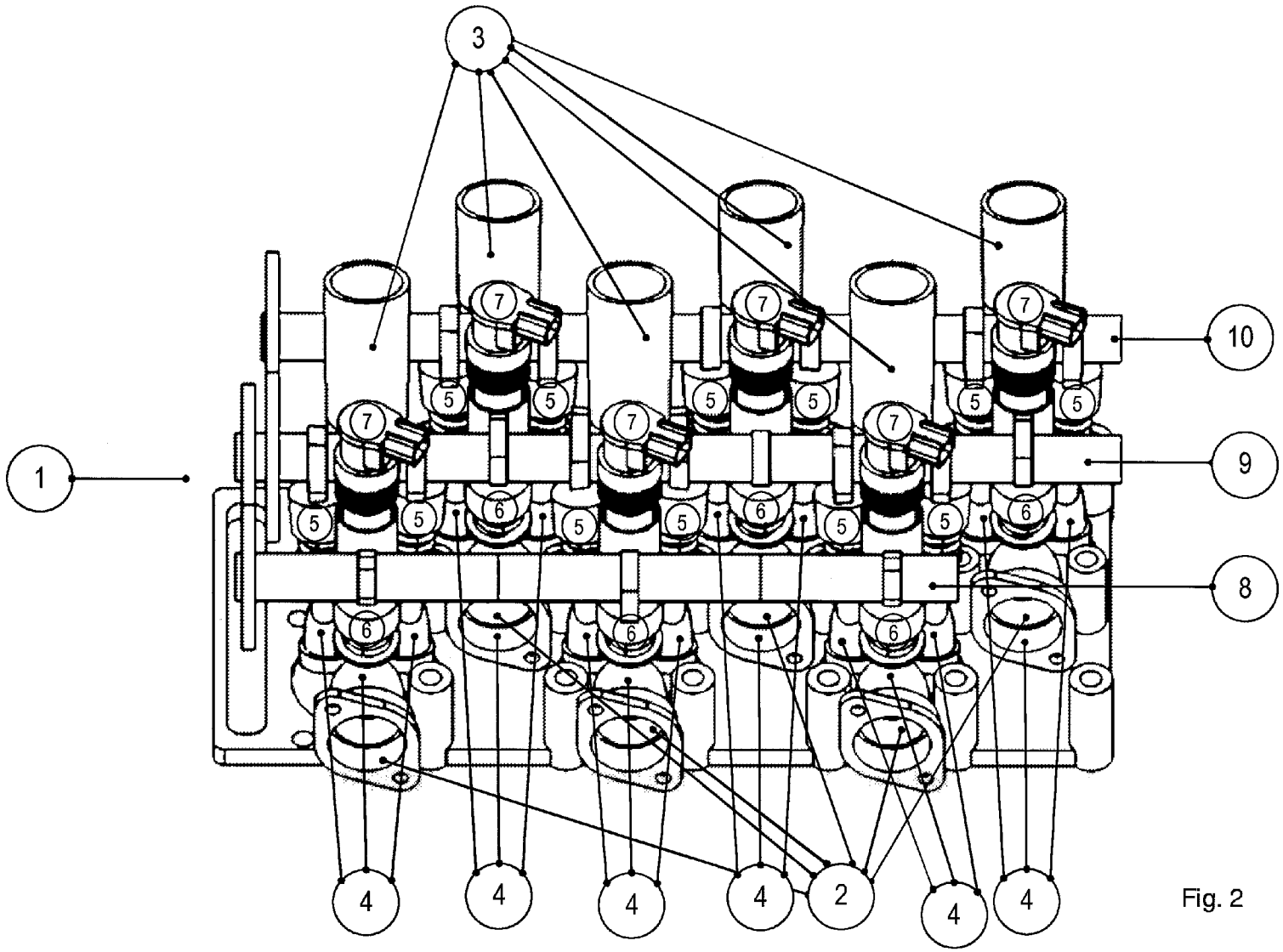

FIG. 2: shows a view of the cylinder head from the front and above

Figure 3:
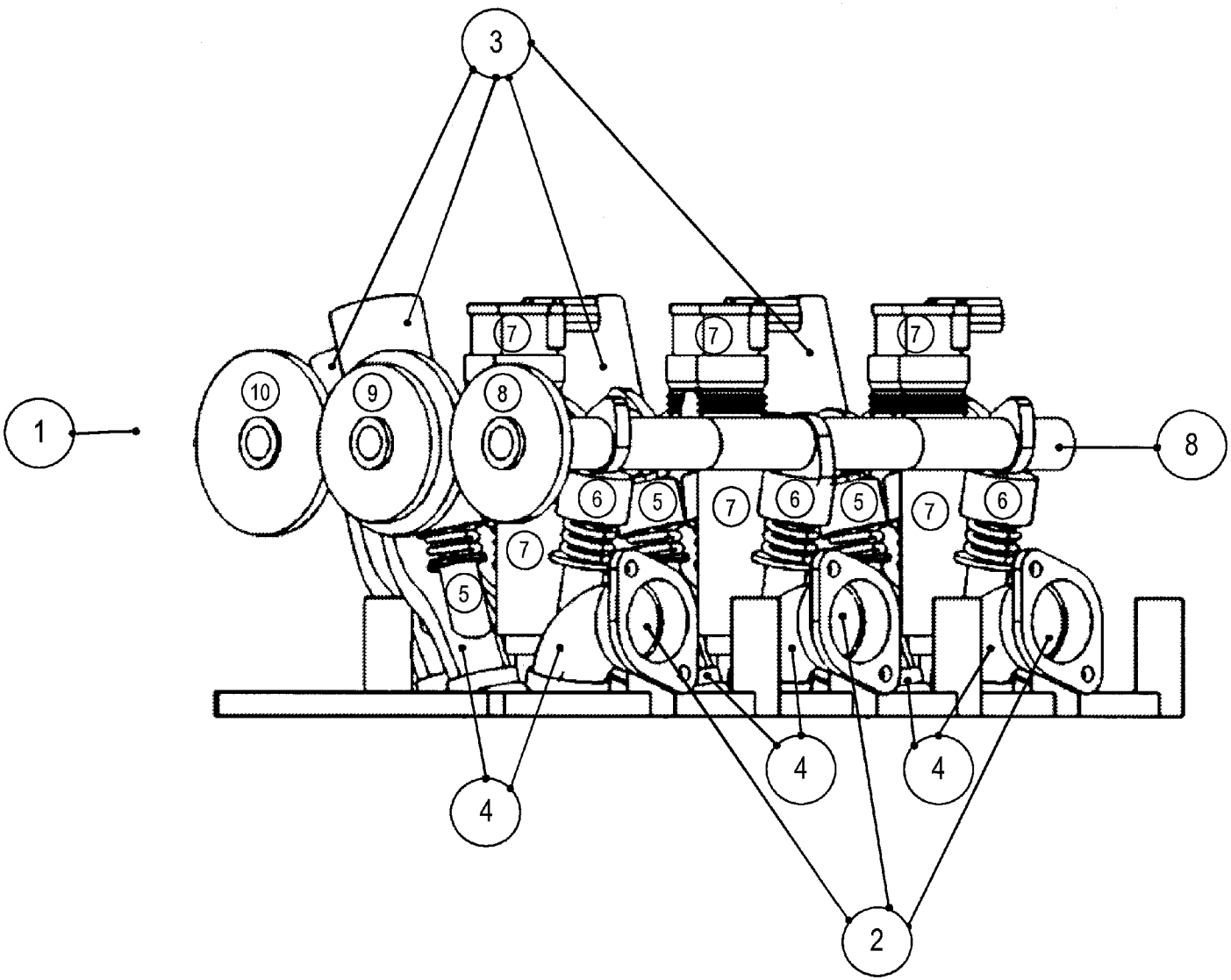

FIG. 3: shows a view of the cylinder head from the front and the right (seen in the longitudinal axis of the vehicle)

Figure 4:
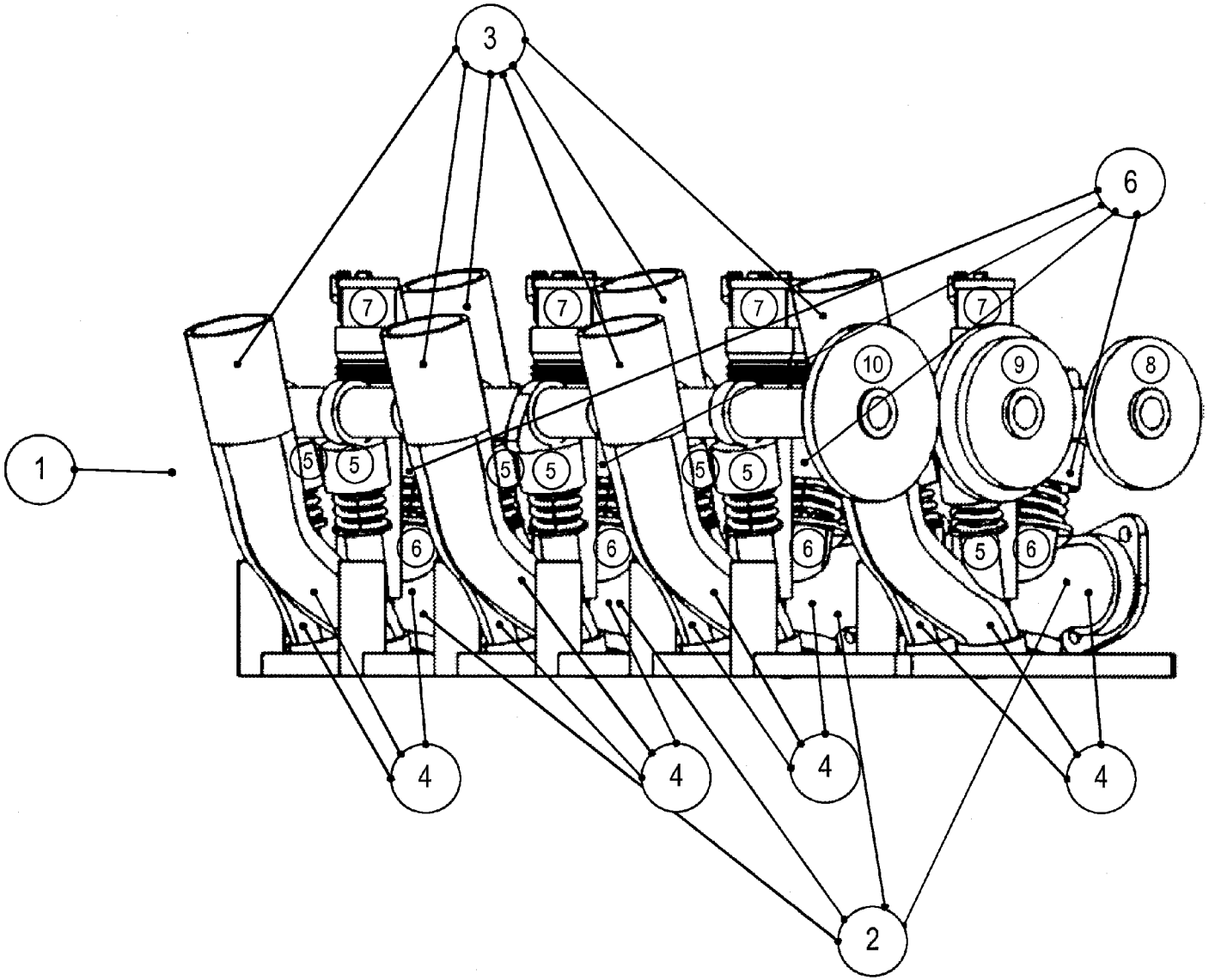

FIG. 4: shows a view of the cylinder head from the rear and the right (seen in the longitudinal axis of the vehicle)

Figure 5:
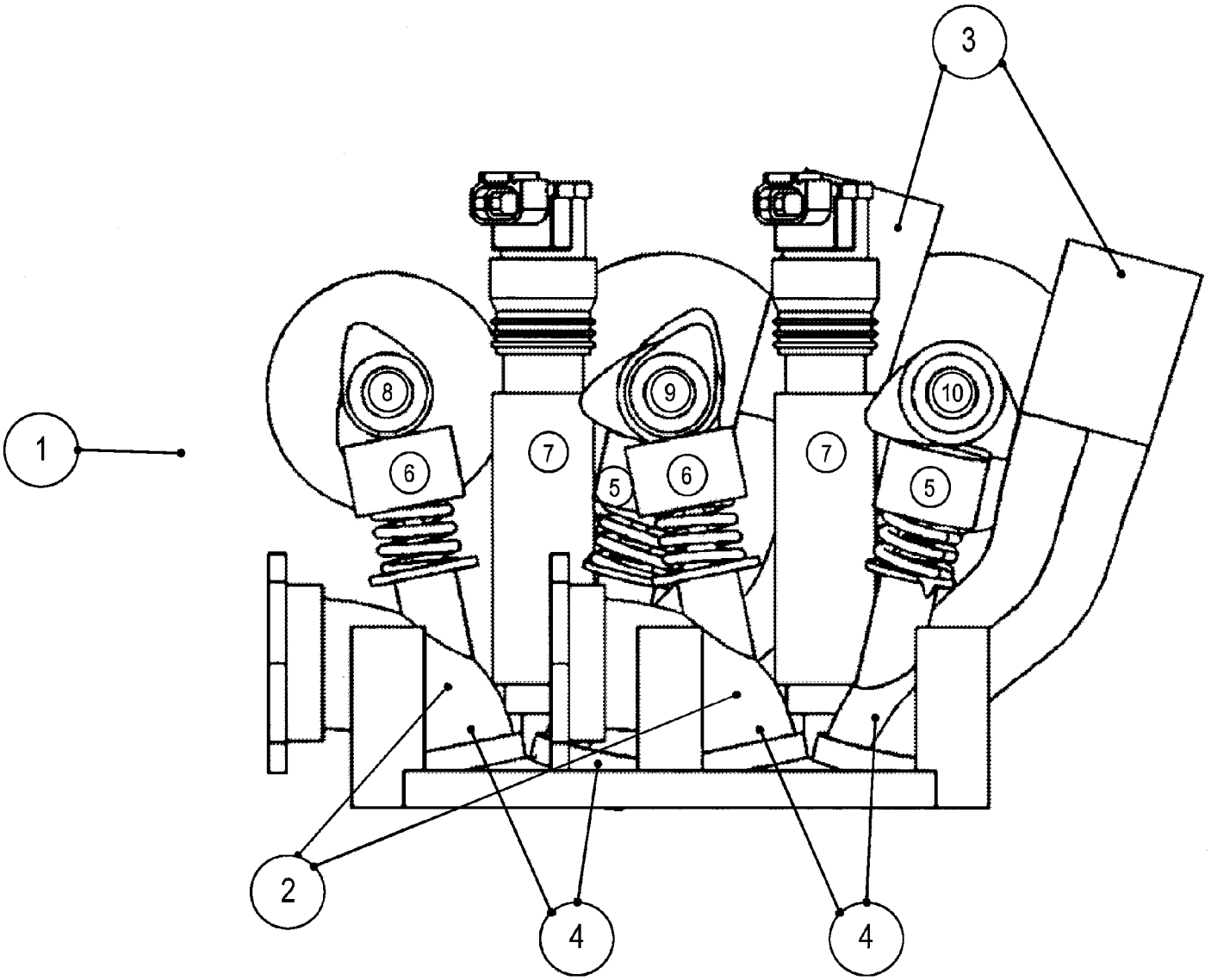

FIG. 5: shows a view of the cylinder head from the left (seen in the longitudinal axis of the vehicle)

Figure 6:
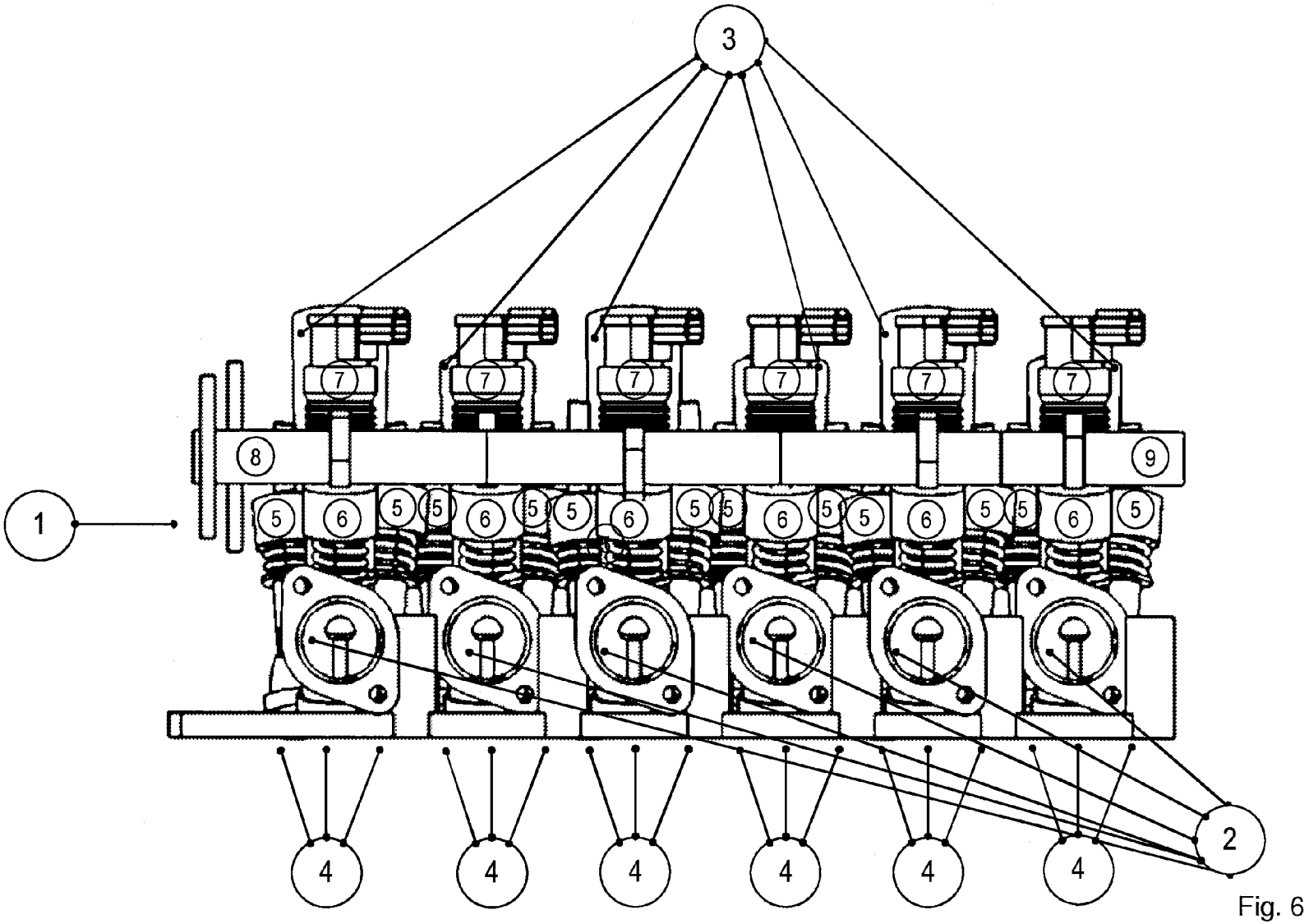

FIG. 6: shows a view of the cylinder head from the front

Figure 7:
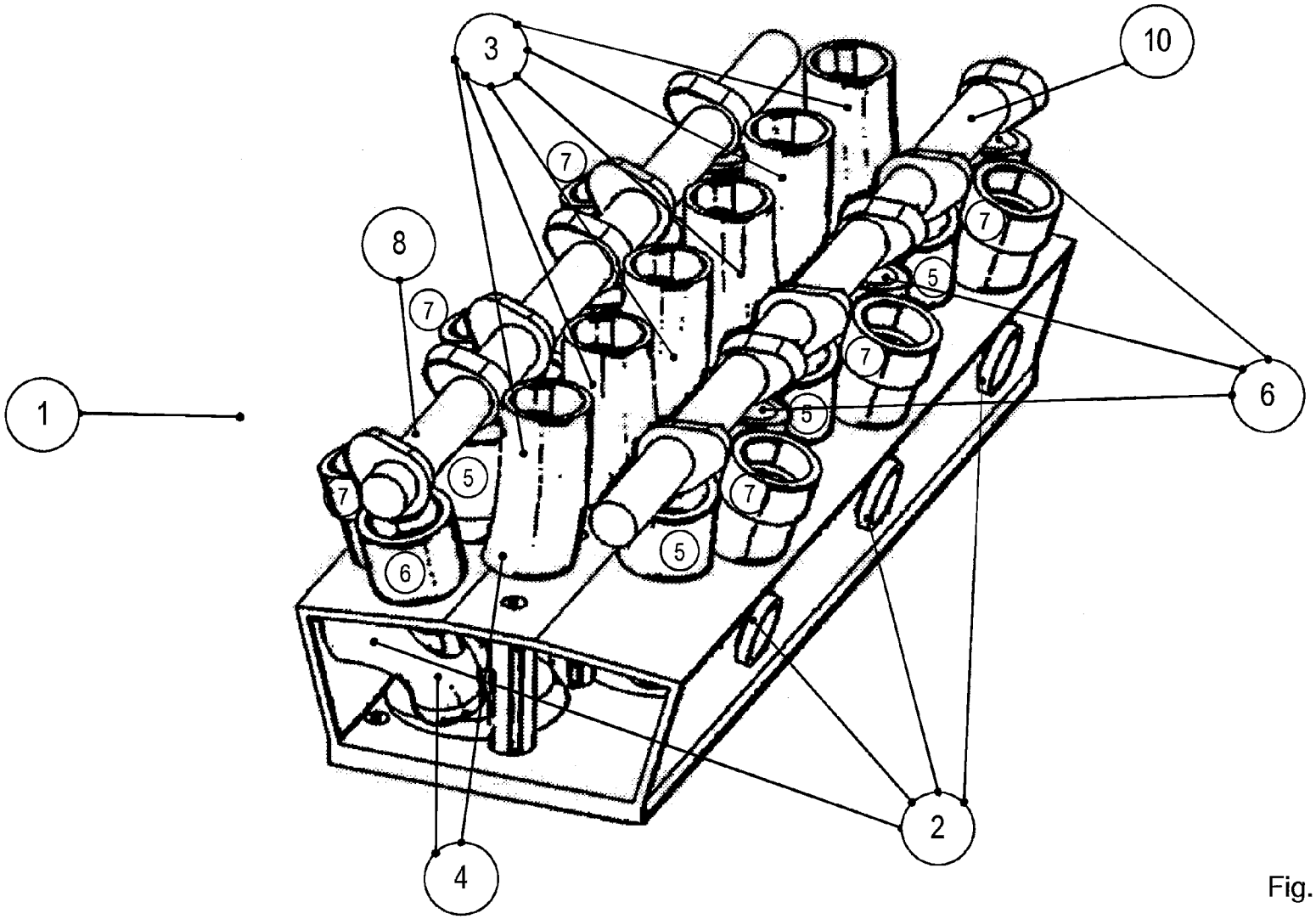

FIG. 7: shows a view of the cylinder head with two camshafts and outlet ducts opening on both sides The parts mentioned in the text are indicated by the following reference symbols:

LIST OF REFERENCE SYMBOLS

1 Cylinder head
2 Outlet duct
3 Inlet duct
4 Duct group
5 Inlet valve
6 Outlet valve
7 Spark plug
8 Front or left or right camshaft
9 Central camshaft
10 Rear or left or right camshaft Further details can be found in the drawings of possible exemplary embodiments of the motorcycle internal combustion engine according to the invention below.

Depending on the installation position of the engine in the motorcycle, the camshaft 8 is arranged at the front in the case of transverse installation, or on the left or right in the case of longitudinal installation. Conversely, the camshaft 10 is arranged at the rear in the case of transverse installation or to the left or right in the case of longitudinal installation.

FIG. 1 shows the view of an embodiment of the cylinder head 1 of the motorcycle internal combustion engine according to the invention with six cylinders. The cylinder head 1 has three camshafts. The outlet ducts 2 run under the central and front camshaft and open out at the front in the longitudinal direction of the vehicle, if the engine is installed with a transverse crankshaft (transverse installation). If the crankshaft lies longitudinally (longitudinal installation) the outlet ducts 2 open out to the left or right. All the outlet ducts 2 have the same geometry and the same dimensions and aligned towards the front (to the side in the case of longitudinal installation), the outlet ducts 2 of the rear row of cylinders being offset to the rear and opening between or adjacently to the inlet valves 5 of the cylinders of the front row of cylinders. All the inlet ducts 3 likewise have the same geometry and dimensions and lead upwards and obliquely to the rear (in the case of transverse installation) or on the opposite side to the outlet duct openings (in the case of longitudinal installation). The inlet ducts 3 and the outlet duct 2 of a cylinder in each case form one duct group 4. The cylinder head 1 also comprises two inlet valves 5 and one outlet valve 6 per cylinder.

In the figures, each duct group 4 includes two inlet ducts, which merge to form one, and one outlet duct, which is indicated in each case by three reference lines. The inlet ducts 3 belonging to the two inlet valves 5 of a cylinder merge to form one inlet duct 3 which leads upwards. The inlet ducts 3 of the rear row of cylinders lead upwards behind the rear camshaft 10, the inlet ducts 3 of the front row of cylinders leads upwards behind the central camshaft 9 and in front of the rear camshaft 10. The outlet ducts 2 of the rear row of cylinders are arranged under the central and front camshafts 8, 9 and lead forwards under these two camshafts. The camshaft drive is arranged on the right in the longitudinal axis of the vehicle. In the case of longitudinal installation, the rear and front camshafts 8, 10 are on the right and left or vice versa. All the valves are actuated by the camshafts directly by means of bucket tappets. The spark plugs 7 are in each case arranged centrally between the two inlet valves 5 and the outlet valve 6. The two inlet valves 5 of a cylinder are arranged in an inclined manner with respect to each other, so the intersection point of their axes is in the combustion chamber of the cylinder.

FIG. 2 shows the view of the cylinder head 1 from the front and above (in the case of transverse installation). Each cylinder comprises two inlet valves 5 and one outlet valve 6, which are all actuated by the camshafts 8, 9, 10 by means of bucket tappets. The inlet ducts 3 of the two inlet valves 5 branch out from a common inlet duct 3 coming from above. The central camshaft 9 actuates the inlet valves 5 of the front row of cylinders and the outlet valves 6 of the rear row of cylinders (in the case of transverse installation). In the case of longitudinal installation, the central camshaft 9 actuates the inlet valves 5 of a lateral row of cylinders and the outlet valves 6 of the opposite row of cylinders. The spark plugs 7 are each arranged between the outlet valve 6 and the two inlet valves 5. FIG. 2 also shows the arrangement of the inlet ducts 3 of the rear row of cylinders behind the rear camshaft 10 and the arrangement of the inlet ducts 3 of the front row of cylinders between the rear and central camshafts. The front camshaft 8 only actuates the outlet valves 6 of the front row of cylinders.

FIG. 3 shows the curved profile of the outlet ducts 2 of the front row of cylinders. The valves are arranged obliquely and are actuated by the camshafts directly by means of bucket tappets.

FIG. 4 shows the s-shaped profile in the inlet ducts 3 and the branching thereof just above the valve seats of the inlet valves 5. The rear camshaft 10 actuates the inlet valves 5 of the rear row of cylinders.

FIG. 5 shows the cylinder head 1 as seen from the left. The outlet ducts 2 are curved towards the front by approx. 90 degrees. The inlet ducts 3 run in an s-shaped manner to the rear and upwards. The spark plugs 7 are arranged perpendicularly. The central camshaft 9 actuates the inlet valves 5 of the front row of cylinders and the outlet valves 6 of the rear row of cylinders. The valves actuated by the central camshaft are inclined with respect to each other.

FIG. 6 shows the view of the cylinder head from the front. All the outlet ducts 2 are arranged at the same height. All the camshafts 8, 9, 10 are also arranged at the same height, therefore only the front camshaft 8 can be seen completely in FIG. 6. From the camshaft 9, the left-hand part of the central camshaft 9 can be seen on the right-hand side in the figure (viewed in the longitudinal direction of the vehicle).

FIG. 7 shows a further embodiment of the cylinder head 1 according to the invention for a VR6 engine. The cylinder head comprises two camshafts 8, 10. The outlet ducts 2 open out on both sides of the cylinder head 1: Three outlet ducts 2 open out on the left, three outlet ducts 2 open out on the right. All six inlet ducts 3 are arranged between the two camshafts 8, 10 are lead upwards. The outlet duct 2 and the inlet duct 3 of a cylinder form one duct group 4, which comprises only two ducts in this exemplary embodiment. The duct groups 4 of one row of cylinders are arranged in a mirror-inverted manner with respect to the duct groups 4 of the other row of cylinders. The duct dimensions of all the duct groups are the same. The camshafts 8, 10 actuate the associated valves directly by means of bucket tappets. The spark plug 7 is in each case arranged laterally between the inlet and outlet valves.

The invention claimed is:

1. A motorcycle having an internal combustion engine, the cylinder arrangement of which is a VR cylinder arrangement with rows of cylinders which are arranged in a staggered manner and pushed into each other, a crank drive acting on a crankshaft in a restricted manner so that two planes which are formed by cylinder axes of each row of cylinders intersect below an axis of the crankshaft , a common cylinder head being present in each case for two rows of cylinders, wherein the common cylinder head comprises three camshafts;

characterised in that the cylinder head comprises a group of two, three, four or five gas ducts per cylinder, the group comprising at least one outlet duct and at least one inlet duct, and wherein a geometric arrangement, namely a length and a shape, of the at least one inlet duct of each group is the same for all the cylinders, wherein the inlet ducts lead upwards and open out of the common cylinder head, and wherein the intakes of the inlet ducts of one row of cylinders are located above the three camshafts and between two of the three camshafts.

2. The motorcycle according to claim 1, characterised in that a geometrical arrangement, namely a length and shape, of the at least one outlet duct of one group is the same for all the cylinders.

3. The motorcycle according to claim 1, characterised in that the internal combustion engine is installed with a transverse crankshaft and, of the rows of cylinders belonging to the cylinder head, one is the front row of cylinders and the other is the rear row of cylinders.

4. The motorcycle according to claim 1, characterised in that the internal combustion engine is installed with a longitudinal crankshaft and, of the rows of cylinders belonging to the cylinder head , one is the left row of cylinders and the other is the right row of cylinders.

5. The motorcycle according to claim 1, wherein the at least one inlet duct comprises a plurality of inlet ducts and the at least one outlet duct comprises a plurality of outlet ducts belonging to outlet valves and characterised in that a group of the inlet ducts belonging to the inlet valves originate from one common duct and the outlet ducts belonging to the outlet valves merge to form one outlet duct.

6. The motorcycle according to claim 1, characterised in that the at least one outlet duct leads upwards and, in the case of a transverse installation, the at least one outlet duct is curved towards the front or towards the rear.

7. The motorcycle according to claim 1, characterised in that the at least one outlet duct leads upwards and, in the case of a longitudinal installation, the at least one outlet duct is curved towards the left or towards the right.

8. The motorcycle according to claim 6, characterised in that the forwardly curved at least one outlet duct of a rear row of cylinders is also arranged between the forwardly curved at least one outlet duct of a front row of cylinders, an outlet duct of an outermost cylinder of the rear row of cylinders being arranged adjacent to an outlet duct of the cylinder of the front row of cylinders situated in front of it.

9. The motorcycle according to claim 1, wherein a central camshaft of the three camshafts actuates the inlet valves of one row of cylinders and the outlet valves of the other row of cylinders.

10. The motorcycle according to claim 1, characterised in that the at least one inlet duct of a rear row of cylinders is arranged behind a rear camshaft of the three camshafts.

11. The motorcycle according to claim 1, characterised in that the at least one inlet duct of a front row of cylinders is arranged between a front and a rear camshaft of the three camshafts.

12. The motorcycle according to claim 1, characterised in that the at least one inlet duct of a front row of cylinders is arranged behind a central camshaft and in front of a rear camshaft of the three camshafts and the at least one inlet duct of a rear row of cylinders is arranged behind the rear camshaft.

13. The motorcycle according to claim 1, wherein the at least one outlet duct comprises a plurality of outlet ducts and characterised in that all the outlet ducts open out of the cylinder head at the front or to one side in the longitudinal direction of the motorcycle, and the openings of the outlet ducts of a rear row of cylinders are offset to the rear with respect to those of the front row of cylinders.

14. The motorcycle according to claim 1, characterised in that dimensions, namely a length and a shape, of the gas ducts are the same for all the groups.

15. The motorcycle according to claim 1, wherein the at least one inlet duct comprises a plurality of inlet ducts and characterised in that all the inlet ducts open out of the cylinder head at the top or to the rear in the longitudinal direction of the motorcycle or to one side.

16. The motorcycle according to claim 1, characterised in that the at least one outlet is curved and runs under one or more camshafts of the internal combustion engine.

17. A motorcycle having an internal combustion engine, the cylinder arrangement of which is a VR cylinder arrangement with rows of cylinders which are arranged in a staggered manner and pushed into each other, a crank drive acting on a crankshaft in a restricted manner so that two planes which are formed by cylinder axes of each row of cylinders intersect below an axis of the crankshaft , a common cylinder head being present in each case for two rows of cylinders, and the cylinder head having a front camshaft, a central camshaft, and a rear camshaft, the engine including one or more inlet ducts for the cylinders and one or more outlet ducts for the cylinders, characterised in that when the crankshaft lies transversely (transverse installation), the one or more inlet ducts of a rear row of cylinders are arranged behind the rear camshaft and the one or more inlet ducts of a front row of cylinders are arranged in front of the rear camshaft and between the rear camshaft and the central camshaft or, when the crankshaft lies longitudinally (longitudinal installation), the one or more inlet ducts of one row of cylinders are arranged to the left of the front camshaft and the one or more inlet ducts of the other row of cylinders are arranged to the right of said front camshaft and between the front camshaft and the central camshaft; the one or more inlet ducts and the one or more outlet ducts of one cylinder forming a group, a geometrical arrangement, namely a length and a shape, of the one or more inlet ducts of each group is the same for all the cylinders, wherein the inlet ducts lead upwards and open out of the common cylinder head, and wherein the intakes of the inlet ducts of one row of cylinders are located above the three camshafts and between two of the three camshafts.

* * * * *